US009673542B1

(12) United States Patent
Decker et al.

(10) Patent No.: US 9,673,542 B1
(45) Date of Patent: Jun. 6, 2017

(54) POKE-IN ELECTRICAL CONNECTOR HAVING A CONTACT WITH A BASE EXTENDING THROUGH AN OPENING IN A BOTTOM OF A HOUSING

(71) Applicant: TYCO ELECTRONICS CORPORATION, Berwyn, PA (US)

(72) Inventors: Donald Francis Decker, Harrisburg, PA (US); Matthew Edward Mostoller, Hummelstown, PA (US); Jeffrey William Shaffer, Shermans Dale, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/166,520

(22) Filed: May 27, 2016

(51) Int. Cl.

| | |
|---|---|
| ***H01R 4/26*** | (2006.01) |
| ***H01R 4/48*** | (2006.01) |
| ***H01R 12/51*** | (2011.01) |
| ***H01R 12/57*** | (2011.01) |

(52) U.S. Cl.
CPC ..... *H01R 4/4827* (2013.01); *H01R 4/4818* (2013.01); *H01R 12/515* (2013.01); *H01R 12/57* (2013.01)

(58) Field of Classification Search
CPC ..... H01R 4/48; H01R 4/4827; H01R 4/4845
USPC ..... 439/441, 733.1, 816, 835, 78, 883–884, 439/459–460
See application file for complete search history.

(56) References Cited

U.S. PATENT DOCUMENTS

| | | | | |
|---|---|---|---|---|
| 6,074,242 | A * | 6/2000 | Stefaniu | H01R 4/4827 439/441 |
| 6,428,343 | B1 * | 8/2002 | Landis | H01R 4/4827 439/440 |
| 6,796,855 | B2 * | 9/2004 | Fricke | H01R 4/4818 439/835 |
| 7,287,999 | B2 * | 10/2007 | Holterhoff | H01R 4/4836 439/441 |
| 7,780,457 | B2 * | 8/2010 | Schafer | H01R 4/4818 439/76.1 |
| 8,858,269 | B2 * | 10/2014 | Brand | H01R 4/4827 439/733.1 |
| 9,466,911 | B1 * | 10/2016 | Wu | H01R 4/4836 |

* cited by examiner

*Primary Examiner* — Chandrika Prasad

(57) ABSTRACT

A poke-in electrical connector includes a housing having a cavity and a poke-in wire channel open to the cavity. The wire channel receives an electrical wire during a poke-in termination. The housing has a bottom with an opening. A poke-in electrical contact is received in the cavity and held by the housing. The poke-in electrical contact includes a base and an arm extending from the base. The base extends through the opening at the bottom for surface mounting to a circuit board. The base has a generally planar solder pad exposed at the bottom for soldering to the circuit board. The arm has a poke-in beam engaging the electrical wire when poked-in to the corresponding wire channel. The arm is movable to a clearance position to release the poke-in beam from the electrical wire to allow the electrical wire to be removed from the wire channel.

20 Claims, 4 Drawing Sheets

POKE-IN ELECTRICAL CONNECTOR HAVING A CONTACT WITH A BASE EXTENDING THROUGH AN OPENING IN A BOTTOM OF A HOUSING

BACKGROUND OF THE INVENTION

The subject matter described herein relates generally to a poke-in electrical connector for terminating electrical wires.

Electrical systems have a need to electrically connect wires to a circuit board. For example, the wires may be power wires to provide power to the circuit board and other components associated with the circuit board, such as drivers for LED lighting applications. In some known systems, the wires are terminated directly to the circuit board, such as by soldering. The soldering process is time consuming and expensive because the process is difficult to automate and is not repeatable leading to faulty terminations. Additionally, the wires are permanently attached to the circuit board after soldering so rerouting of the wires or repurposing of the circuit board is impractical. In other known systems, electrical connectors are provided that are terminated to the circuit board to electrically connect to the wires. In some such systems, the wires are not easily or practically removable from the electrical connectors. In other systems, the electrical connectors are through-hole mounted connectors having solder pins that are wave soldered to the circuit board. Such connectors are not readily adaptable to pick and place circuit board manufacturing as the circuit board must be processed through a wave solder process. The connectors are typically bulky.

SUMMARY OF THE INVENTION

In an embodiment, a poke-in electrical connector is provided including a housing having a cavity and a poke-in wire channel open to the cavity. The wire channel is configured to receive an electrical wire during a poke-in termination. The housing has a bottom with an opening. A poke-in electrical contact is received in the cavity and held by the housing. The poke-in electrical contact includes a base and an arm extending from the base. The base extends through the opening at the bottom for surface mounting to a circuit board. The base has a generally planar solder pad exposed at the bottom for soldering to the circuit board. The arm has a poke-in beam configured to engage the electrical wire when poked-in to the corresponding wire channel. The arm is movable to a clearance position to release the poke-in beam from the electrical wire to allow the electrical wire to be removed from the wire channel.

In another embodiment, a poke-in electrical connector is provided including a housing having a cavity and a poke-in wire channel open to the cavity. The wire channel is configured to receive an electrical wire during a poke-in termination. The housing has a release channel open to the cavity configured to receive a release tool. The housing has a bottom with an opening. A poke-in electrical contact is received in the cavity and held by the housing. The poke-in electrical contact includes a base and an arm extending from the base. The base extends through the opening at the bottom for surface mounting to a circuit board. The base has a generally planar solder pad exposed at the bottom for soldering to the circuit board. The arm has a poke-in beam configured to engage the electrical wire when poked-in to the corresponding wire channel. The arm has a release tab exposed to the release channel to interact with the release tool. The arm is movable to a clearance position by the release tool interacting with the release tab to release the poke-in beam from the electrical wire to allow the electrical wire to be removed from the wire channel.

In a further embodiment, a poke-in electrical connector is provided including a housing having a cavity and a poke-in wire channel open to the cavity. The wire channel is configured to receive an electrical wire during a poke-in termination. The housing has a bottom with an opening. A poke-in electrical contact is received in the cavity and held by the housing. The poke-in electrical contact includes a base, a first arm extending from a first end of the base and a second arm extending from a second end of the base. The base extends through the opening at the bottom for surface mounting to a circuit board. The base has a generally planar solder pad exposed at the bottom for soldering to the circuit board. The first arm has a poke-in beam configured to engage the electrical wire when poked-in to the corresponding wire channel. The first arm is movable to a clearance position to release the poke-in beam from the electrical wire to allow the electrical wire to be removed from the wire channel. The second arm has a retention barb engaging the housing to secure the poke-in electrical contact to the housing. The second arm has a wire interface configured to electrically engage the electrical wire when received in the poke-in wire channel.

DETAILED DESCRIPTION OF THE DRAWINGS

Figure 1:
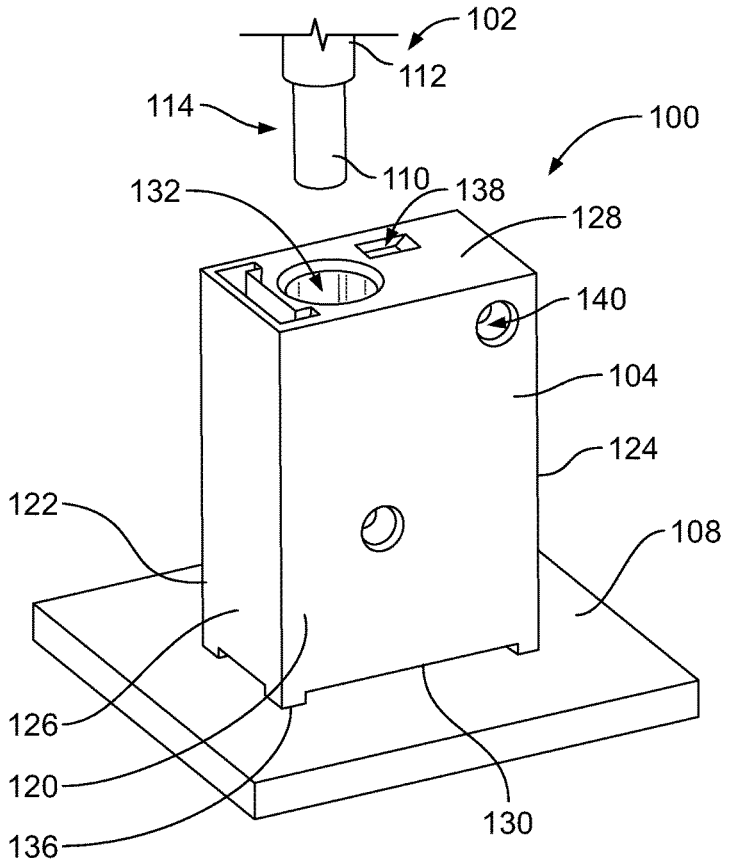
FIG. 1 is a front perspective view of an embodiment of a poke-in electrical connector in accordance with an exemplary embodiment.
Figure 2:
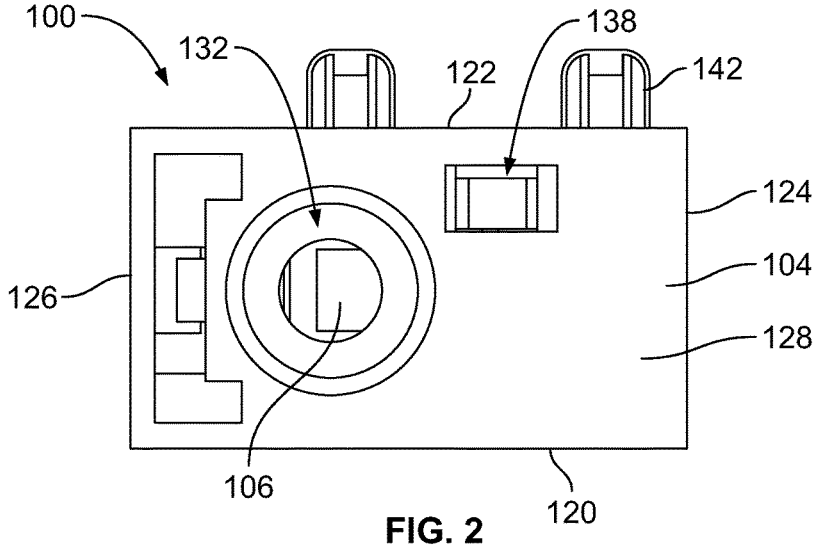
FIG. 2 is a top view of the poke-in electrical connector.
Figure 3:
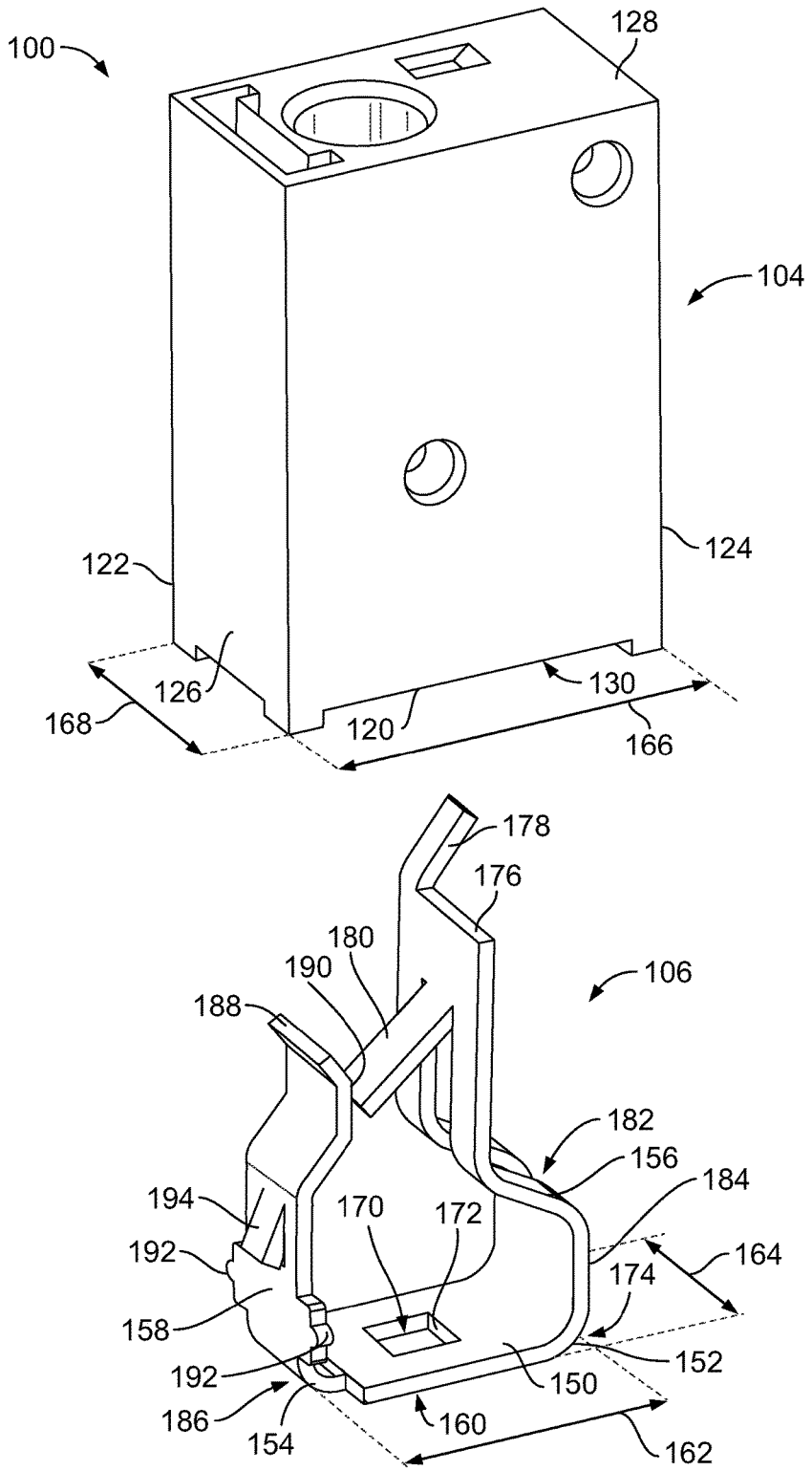
FIG. 3 is an exploded view of the poke-in electrical connector showing a poke-in electrical contact poised for loading into a housing.

FIG. 1 is a front perspective view of an embodiment of a poke-in electrical connector 100 in accordance with an exemplary embodiment. FIG. 2 is a top view of the poke-in electrical connector 100. The electrical connector 100 is a poke-in style connector that allows an electrical wire 102 to be poked-in to a housing 104 of the electrical connector 100 for termination to a poke-in electrical contact 106 (FIG. 3). The electrical connector 100 is configured to be surface mounted to a circuit board 108. For example, the electrical contact 106 may be reflow soldered to the circuit board 108. The electrical contact 106 is releasable to allow the electrical wire 102 to be removed. The electrical connector 100 may be used in various applications, such as a power application to transfer power between the electrical wire 102 and the circuit board 108. For example, the electrical connector 100 may be used in a lighting application, such as to provide power to a driver of a light fixture, such as an LED light fixture; however the electrical connector 100 is not limited to lighting applications or power applications.

Optionally, the electrical connector 100 may be stackable with other electrical connectors or other types of electrical components, such as a different type of electrical connector. For example, the electrical connector 100 may be a power connector configured to transfer power between the electrical wire 102 and the circuit board 108 and the electrical connector 100 may be stacked with other power connectors 100 or may be stacked with non-power electrical connectors, such as data communication connectors.

In the illustrated embodiment, the electrical wire 102 includes an electrical conductor 110 and an insulation layer 112 surrounding the electrical conductor 110. The insulation layer 112 has been stripped away at an end 114 of the electrical wire 102 to expose the electrical conductor 110 along the end 114. The electrical wire 102 is configured to be received in the housing 104 such that the exposed segment of the electrical conductor 110 is physically engaged in electrical connection with the electrical contact 106.

The housing 104 is configured to be mounted to the circuit board 108. The housing 104 includes a front 120, a rear 122 and opposite first and second sides 124, 126 that extend between a top 128 and a bottom 130 of the housing 104. The bottom 130 is configured to be mounted to the circuit board 108. The housing 104 may have other shapes in alternative embodiments including other sides. The housing 104 includes a poke-in wire channel 132 that receives the electrical wire 102. In the illustrated embodiment, the poke-in wire channel 132 is open at the top 128. While the electrical wire 102 is illustrated as being configured to be loaded into the housing 104 through the top 128, the electrical wire 102 may be loaded through other sides in alternative embodiments, such as the front 120, the rear 122, the first side 124 or the second side 126.

The poke-in wire channel 132 is open to a cavity 134 (shown in FIG. 4) defined by the housing 104 that receives the poke-in electrical contact 106. For example, the poke-in electrical contact 106 may be loaded into the cavity 134 through an opening in the bottom 130. In an exemplary embodiment, a portion of the electrical contact 106 may be exposed at the bottom 130 for surface mounting to the circuit board 108. For example, a portion of the electrical contact 106 may be set proud of the bottom 130 (for example, slightly below the bottom 130). The electrical contact 106 may be set in solder paste on the circuit board 108 and the electrical contact 106 may be soldered to the circuit board 108 during a reflow soldering process.

Optionally, the housing 104 includes stand-offs 136 at the bottom 130. The stand-offs 136 may rest on the circuit board 108. The stand-offs 136 may control positioning of the housing 104 on the circuit board 108. Optionally, portions of the stand-offs 136 may be received in openings in the circuit board 108 to locate the housing 104 relative to the circuit board 108.

In an exemplary embodiment, the housing 104 includes a release channel 138 open to the cavity 134 that is configured to receive a release tool to release the poke-in electrical contact 106 from the electrical wire 102 to allow the electrical wire 102 to be removed from the wire channel 132. In the illustrated embodiment, the release channel 138 is open at the top 128.

In an exemplary embodiment, the housing 104 is stackable, such as with other housings 104 of other electrical connectors 100. The housings 104 may be coupled together. For example, in the illustrated embodiment, the housing 104 includes stack-holes 140 at the front 120 and stack-posts 142 at the rear 122. The stack-posts 142 are configured to be received in corresponding stack-holes 140 of another housing 104 to stack the housings 104 together. The stack-holes 140 are configured to receive corresponding stack-posts 142 of another housing 104 to stack the housings 104 together.

FIG. 3 is an exploded view of the electrical connector 100 showing the poke-in electrical contact 106 poised for loading into the housing 104. The housing 104 is open at the bottom 130 to receive the electrical contact 106. The electrical contact 106 includes features to secure the electrical contact 106 in the housing 104. The electrical contact 106 includes features for surface mounting to the circuit board 108 (shown in FIG. 1).

In an exemplary embodiment, the electrical contact 106 is a stamped and formed contact stamped from a metal material, such as a copper or copper alloy. Optionally, the electrical contact 106 may be selectively plated with one or more plating layers to enhance characteristics of the electrical contact 106.

The electrical contact 106 includes a base 150 extending between a first end 152 and a second end 154. The electrical contact 106 includes a first arm 156 extending from the first end 152 and a second arm 158 extending from a second end 154. In an exemplary embodiment, both arms 156, 158 are configured to directly engage the electrical wire 102 (shown in FIG. 1) to electrically connect the electrical contact 106 to the electrical wire 102; however, the electrical contact 106 may include a single point of contact with the electrical wire 102 in alternative embodiments.

The base 150 has a generally planar solder pad 160 configured to be exposed at the bottom 130 for soldering to the circuit board 108. In an exemplary embodiment, the solder pad 160 extends generally parallel to the bottom 130 for surface mounting to the circuit board 108. Optionally, the solder pad 160 may be relatively large to provide a large surface area for surface mounting to the circuit board 108. The solder pad 160 has a width 162 and a depth 164. Optionally, the width 162 may be approximately equal to a width 166 of the housing 104 between the first and second sides 124, 126. Optionally, the depth 164 may be approximately equal to a depth 168 of the housing 104 between the front 120 and the rear 122 of the housing 104. Having the width 162 and the depth 164 approximately equal to the width 188 and the depth 168 provides a large surface area for the solder pad 160 for surface mounting to the circuit board 108.

In an exemplary embodiment, the base 150 includes an opening 170 having a plurality of edges 172. The opening 170 may be located at an interior position of the solder pad 160. Optionally, multiple openings 170 may be provided. The opening 170 is configured to receive solder paste to enhance the mechanical connection to the circuit board 108. For example, the solder paste may engage the edges 172 to increase the surface area for interfacing with the solder paste. Optionally, at least some of the solder paste may extend entirely through the opening 170 to the interior surface of the base 150.

The first arm 156 extends from the base 150 from a corner 174 defined at the first end 152. Optionally, the corner 174 may be curved. The first arm 156 extends to a distal end 176. In an exemplary embodiment, the first arm 156 includes a release tab 178 at or near the distal end 176. The release tab 178 is configured to be aligned with the release channel 138 to interface with the release tool to release the electrical contact 106 from the electrical wire 102 to allow the electrical wire 102 to be removed from the wire channel 132. In the illustrated embodiment, the release tab 178 is angled outward.

In an exemplary embodiment, the first arm 156 includes a poke-in beam 180 configured to engage the electrical wire 102 when poked-in to the corresponding wire channel 132. In the illustrated embodiment, the poke-in beam 180 is angled inward from the first arm 156. The poke-in beam 180 defines a wire trap configured to retain the electrical wire 102 in the housing 104. For example, an edge of the poke-in beam 180 may dig into the electrical wire 102 to restrict removal of the electrical wire 102 when the poke-in beam 180 engages the electrical wire 102. In an exemplary embodiment, the poke-in beam 180 may be released from the electrical wire 102, such as by releasing the release tab 178 using the release tool.

In an exemplary embodiment, the first arm 156 includes a transition portion 182 that transitions the first arm 156 inward toward a center of the electrical contact 106. The transition portion 182 shifts the poke-in beam 180 inward toward the second arm 158 such that the electrical wire 102 may be captured therebetween. The transition portion 182 transitions the first arm 156 inward to provide clearance or space to allow the first arm 156 to be deflected outward during releasing of the electrical contact 106 from the electrical wire 102. The transition portion 182 transitions from a brace 184 of the first arm 156. The brace 184 provides isolation of the movement and stresses associated with the movement of the first arm 156 with respect to the base 150 and the solder past securing the base 150 to the circuit board 108. The brace 184 may engage the housing 104 to position the electrical contact 106 within the housing 104. The brace 184 may engage the housing 104 to isolate stresses or strains from the base 150 and the solder, such as during deflection of the first arm 156 during releasing of the electrical wire 102.

The second arm 158 extends from the second end 154 of the base 150 at a corner 186. The second arm 158 extends to a distal end 188. In an exemplary embodiment, the second arm 158 includes a wire interface 190 configured to electrically engage the electrical wire 102 when received in the poke-in wire channel 132. The wire interface 190 may be provided at or near the distal end 188. Optionally, the wire interface 190 may be aligned with the poke-in beam 180 such that the electrical wire 102 is captured between the wire interface 190 and the poke-in beam 180. In the illustrated embodiment, the wire interface 190 is flat and may be generally perpendicular to the base 150. The second arm 158 may include a lead-in at the distal end 188 to the wire interface 190 to prevent stubbing of the electrical wire 102 with the electrical contact 106 during loading of the electrical wire 102.

The second arm 158 includes protrusions 192 at the edges. The protrusions 192 are configured to engage the housing 104 to secure the electrical contact 106 in the housing 104. For example, the protrusions 192 may dig into the material of the housing 104 to secure the electrical contact 106 in the housing 104 by an interference fit.

In an exemplary embodiment, the second arm 158 includes a barb 194 extending therefrom. The barb 194 may extend outward from the second arm 158. The barb 194 may be used to lock the electrical contact 106 in the housing 104. In an exemplary embodiment, the barb 194 is deflectable and may spring outward when the electrical contact 106 is received in the housing 104 to lock the electrical contact 106 in the housing 104.

Figure 4:
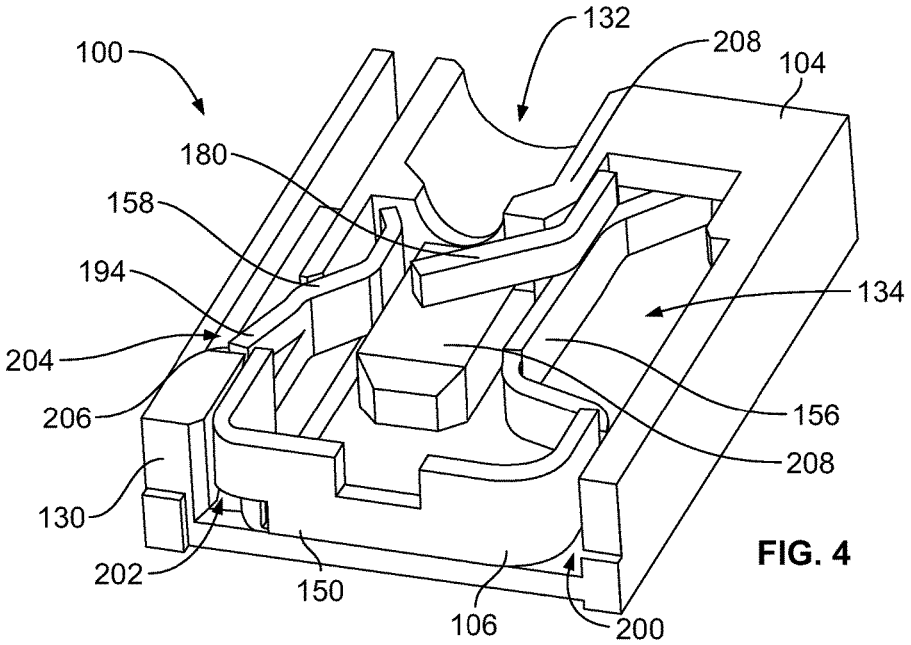
FIG. 4 is a partial sectional view of the poke-in electrical connector in accordance with an exemplary embodiment.

FIG. 4 is a partial sectional view of the poke-in electrical connector 100 in accordance with an exemplary embodiment. FIG. 4 illustrates the electrical contact 106 loaded into the cavity 134 of the housing 104. The housing 104 includes an opening 200 at the bottom 130 through which the electrical contact 106 is loaded. The electrical contact 106 is loaded into the cavity 134 such that the base 150 is substantially aligned with the bottom 130 of the housing 104.

The housing 104 includes a slot 202 that receives at least a portion of the second arm 158. For example, the slot 202 receives the protrusions 192 of the second arm 158. The housing 104 includes a pocket 204 at one side of the cavity 134 that receives the barb 194. When the electrical contact 106 is fully loaded into the cavity 134, the barb 194 springs outward into the pocket 204 above a stop surface 206. The stop surface 206 blocks the barb 194 and thus blocks removal of the electrical contact 106 from the cavity 134. Optionally, the barb 194 may be released by a release tool to allow removal of the electrical contact 106 from the housing 104.

In an exemplary embodiment, the housing 104 includes a lug 208 extending into the cavity 134. The lug 208 may define portions of the cavity 134. The lug 208 may define portions of the poke-in wire channel 132. In the illustrated embodiment, the lug 208 is positioned between the first and second arms 156, 158. Portions of the arms 156, 158 may engage opposite sides of the lug 208 to position the electrical contact 106 within the housing 104. Optionally, the poke-in beam 180 may extend across a portion of the lug 208, such as the portion aligned with the poke-in wire channel 132 to interface with the electrical wire 102 when the electrical wire 102 is loaded into the poke-in wire channel 132.

Figure 5:
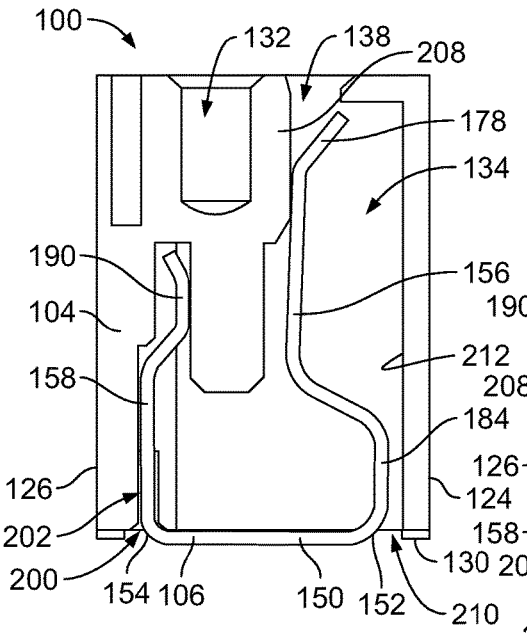
FIG. 5 is a cross-sectional view of the poke-in electrical connector showing the electrical contact in a nominal position.
Figure 6:
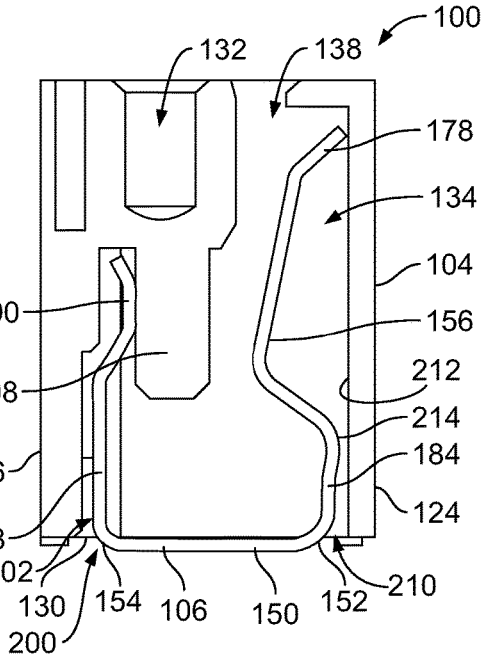
FIG. 6 is a cross-sectional view of the poke-in electrical connector showing the poke-in electrical contact in a clearance position.

FIG. 5 is a cross-sectional view of the poke-in electrical connector 100 showing the electrical contact 106 in a nominal position. FIG. 6 is a cross-sectional view of the poke-in electrical connector 100 showing the poke-in electrical contact 106 in a clearance position. When the electrical contact 106 is loaded into the housing 104, the base 150 is generally fixed relative to the housing 104. For example, the electrical contact 106 may be fixed at the second end 154 by a portion of the second arm 158 and the protrusions 192 being received in the slot 202.

The base 150 extends across the opening 200. In an exemplary embodiment, the base 150 encompasses substantially the entire width and the entire depth of the opening 200 to the cavity 134 at the bottom 130. For example, the base 150 extends substantially entirely across the opening 200 between the wall defining the first side 124 and the wall defining the second side 126, such as to or near the interior surfaces of such walls. In an exemplary embodiment, a slight gap 210 is provided between the first end 152 and the wall of the housing 104 defining the first side 124. Such gap 210 may allow the first arm 156 to flex or deflect to the clearance position. Alternatively, the base 150 may extend to the first wall such that the first arm 156 (for example, the brace 184) engages the first wall defining the first side 124.

In the nominal position, the first arm 156 engages the lug 208. The lug 208 may stop inward deflection of the first arm 156 and hold the first arm 156 at a predetermined position within the cavity 134. Optionally, the first arm 156 may be partially deflected in the nominal position. For example, the first arm 156 may be partially elastically deformed in the nominal position. Similarly, the second arm 158 engages the lug 208 in the nominal position. For example, the wire interface 190 may engage a side wall of the lug 208 to position the wire interface 190 within the cavity 134. In an exemplary embodiment, the wire interface 190 is positioned in the cavity 134 such that the wire interface 190 is configured to interfere with the electrical wire 102 when the electrical wire 102 is poked-in to the wire channel 132. For example, the second arm 158 may be deflected outward by the electrical wire 102 when the electrical wire 102 is poked-in to the wire channel 132. The cavity 134 provides clearance behind the second arm 158 to allow the second arm 158 to deflect outward.

In an exemplary embodiment, the electrical contact 106 is releasable from the electrical wire 102 by moving the first arm 156 to the clearance position (FIG. 6). For example, a release tool may be received in the release channel 138 to engage the release tab 178 and press the first arm 156 outward. The cavity 134 provides clearance outward of the first arm 156 to allow the first arm 156 to pivot or move away from the wire channel 132. In an exemplary embodiment, an interior surface 212 of the housing 104 defining the cavity 134 along the wall of the housing 104 defining the first side 124 may define a stop surface for the first arm 156, such as to limit travel of the first arm 156. The stop surface 212 eliminates the risk of plastic deformation of the electrical contact 106 during releasing of the electrical contact 106 from the electrical wire 102.

In an exemplary embodiment, the brace 184, which is proximate to the base 150, may engage the interior surface 212 of the housing 104 when the first arm 156 is released. The brace 184 may provide support for the first arm 156. The brace 184 may prevent over-travel of the first arm 156 to prevent plastic deformation. Optionally, the brace 184 may define a pivot point 214 for the first arm 156 as the first arm 156 is pivoted to the clearance position. Such pivot point 214 may be remote from the base 150, such as at the top of the brace 184. The brace 184 may isolate stress in the first arm 156 from the base 150 as the first arm 156 moves to the clearance position by remaining generally stationary as the upper portion of the first arm 156 is released to the clearance position. As such, the solder connection between the base 150 and the circuit board 108 may be protected from damage by the brace 184. In alternative embodiments, such as when the gap 210 is sufficiently wide, the first arm 156 may pivot about the first end 152 of the base 150 without engaging the interior surface 212.

Figure 9:
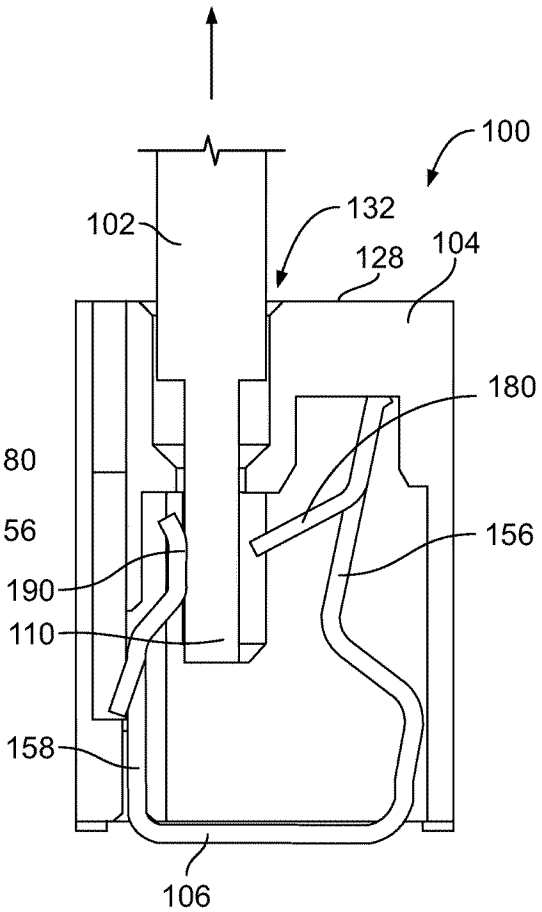
FIG. 9 is a cross-sectional view of the poke-in electrical connector showing the electrical wire being removed from the housing.
Figure 8:
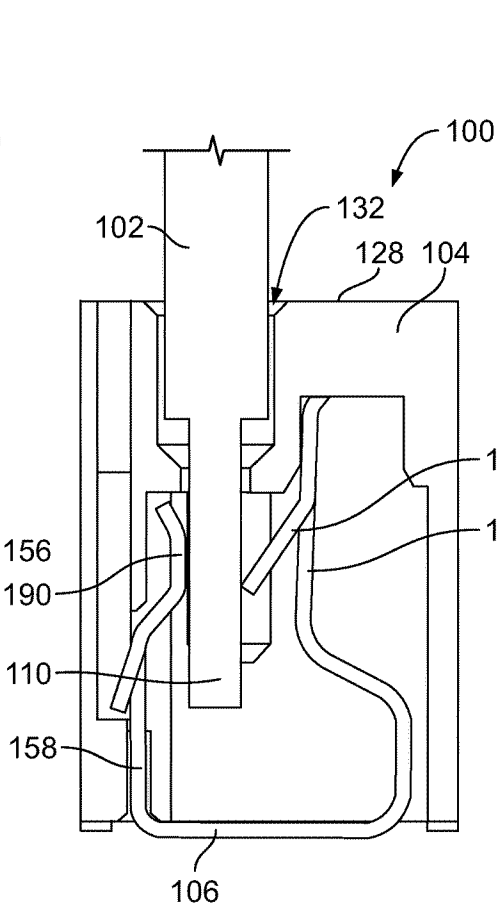
FIG. 8 is a cross-sectional view of the poke-in electrical connector showing the electrical wire fully loaded into the housing.
Figure 7:
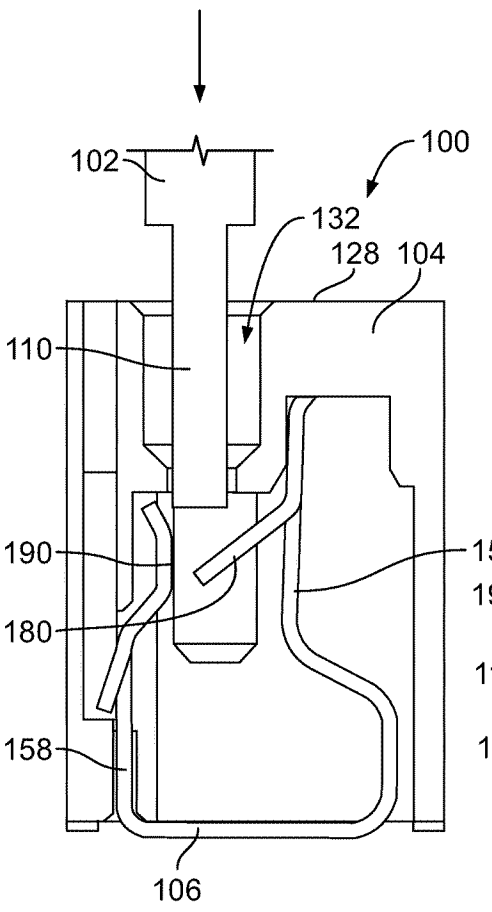
FIG. 7 is a cross-sectional view of the poke-in electrical connector showing an electrical wire being loaded into the housing.

FIG. 7 is a cross-sectional view of the poke-in electrical connector 100 showing the electrical wire 102 being loaded into the housing 104. FIG. 8 is a cross-sectional view of the poke-in electrical connector 100 showing the electrical wire 102 fully loaded into the housing 104. FIG. 9 is a cross-sectional view of the poke-in electrical connector 100 showing the electrical wire 102 being removed from the housing 104. The electrical connector 100 maintains the soldered connection to the circuit board 108 as the electrical wire 102 is inserted into the housing 104 and is removed from the housing 104.

The electrical wire 102 is loaded into the poke-in wire channel 132 through the top 128 (FIG. 7). The electrical contact 106 is in the nominal position awaiting reception of the electrical wire 102. The poke-in beam 180 spans across the poke-in wire channel 132 to interfere with the electoral wire 102 when the electrical wire 102 is loaded into the wire channel 132.

When the electrical wire 102 is fully loaded into the housing 104 (FIG. 8) the poke-in beam 180 engages one side of the electrical conductor 110 and presses the electrical wire 102 against the wire interface 190 of the second arm 158. The wire interface 190 directly engages the electrical conductor 110 such that the wire interface 190 and the poke-in beam 180 define multiple points of contact with the electrical conductor 110. The electrical wire 102 is captured between the wire interface 190 and the poke-in beam 180. In the illustrated embodiment, the opposing poke-in beam 180 and wire interface 190 pinch the electrical wire 102 therebetween to engage in physical contact with the electrical wire 102 and thereby establish an electrical connection between the contact 106 and the wire 102. The poke-in beam 180 and wire interface 190 oppose each other and are spring biased toward each other. When the wire 102 is inserted between the poke-in beam 180 and wire interface 190, the poke-in beam 180 and wire interface 190 spread apart and press against the wire 102 to ensure a reliable electrical connection between the contact 106 and the wire 102.

The poke-in beam 180 defines a wire trap to resist pullout of the electrical wire 102. For example, the edge of the poke-in beam 180 may dig into the electrical conductor 110 to resist removal of the electrical wire 102. Optionally, the first arm 156 and/or the second arm 158 may be at least partially deflected outward by the electrical wire 102 such that the first arm 156 and/or the second arm 158 are spring biased inward against the electrical wire 102 to ensure that electrical contact is maintained between the electrical wire 102 and the poke-in electrical contact 106.

The pinch connection between the poke-in beam 180 and/or the wire interface 190 and the electrical wire 102 is a separable connection. A "separable connection" is a connection wherein the corresponding electrical wire 102 can be terminated by the electrical contact 106 without damaging the electrical contact 106 and/or without damaging the electrical wire 102. For example, a "separable connection" may be a connection wherein: (1) the corresponding electrical wire 102 can be installed to the electrical contact 106 (i.e., captured between the poke-in beam 180 and wire interface 190 with the compliant pinch connection) and later uninstalled from the electrical contact 106 (i.e., removed from between the poke-in beam 180 and wire interface 190) without damaging the electrical contact 106 such that another electrical wire 102 can be installed to the electrical contact 106; and/or (2) the corresponding electrical wire 102 can be installed in the same or another location.

The electrical contact 106 is releasable from the electrical wire 102. For example, the first arm 156 is moved to the clearance position (FIG. 9) in which clearance is provided between the poke-in beam 180 and the wire 102 to allow the electrical wire 102 to be pulled out of the housing 104. The first arm 156 has a long effective length to provide good spring characteristics. When the first arm 156 is deformed and flexed outward, such as during releasing of the electrical wire 102, the long effective length reduces the risk of plastic deformation of the first arm 156 insuring that the electrical contact 106 maintains the spring characteristics. When the electrical contact 106 is in the clearance position, the electrical wire 102 is allowed to be removed from the wire channel 132. For example, the poke-in beam 180 may be spaced apart from the electrical wire 102 or may touch the electrical wire 102 with insufficient retaining force such that the electrical wire 102 may be removed. Additionally, the flat surface of the wire interface 190 does not stop removal of the electrical wire 102 from the wire channel 132.

It is to be understood that the above description is intended to be illustrative, and not restrictive. For example, the above-described embodiments (and/or aspects thereof)

may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A poke-in electrical connector comprising:

a housing having a cavity and a poke-in wire channel open to the cavity, the wire channel being configured to receive an electrical wire during a poke-in termination, the housing having a bottom with an opening; and a poke-in electrical contact received in the cavity and held by the housing, the poke-in electrical contact comprising a base and an arm extending from the base, the base extending through the opening at the bottom for surface mounting to a circuit board, the base having a generally planar solder pad exposed at the bottom for soldering to the circuit board, the arm having a poke-in beam configured to engage the electrical wire when poked-in to the corresponding wire channel, the arm being movable to a clearance position to release the poke-in beam from the electrical wire to allow the electrical wire to be removed from the wire channel.

2. The poke-in electrical connector of claim 1, wherein the solder pad extends generally parallel to the bottom for surface mounting to the circuit board.

3. The poke-in electrical connector of claim 1, wherein the solder pad encompasses substantially an entire width and an entire depth of the cavity at the bottom.

4. The poke-in electrical connector of claim 1, wherein the poke in wire channel is open at a top of the housing to receive the electrical wire in a loading direction generally perpendicular to the bottom.

5. The poke-in electrical connector of claim 1, wherein the housing includes a front, a rear, and opposite first and second sides between the front and the rear, the solder pad extending a majority of the depth from the front to the rear and a majority of the width from the first side to the second side.

6. The poke-in electrical connector of claim 1, wherein the arm includes a release tab configured to be engaged by a release tool to move the arm to the clearance position.

7. The poke-in electrical connector of claim 1, wherein the poke in electrical contact further comprises a second arm extending from the base, the second arm having a wire interface configured to electrically engage the electrical wire when received in the poke in wire channel.

8. The poke-in electrical connector of claim 1, wherein the solder pad comprises an opening having a plurality of edges, the opening configured to receive solder paste at the edges.

9. The poke-in electrical connector of claim 1, wherein the poke in electrical contact includes a corner at the intersection of the base and the arm, the arm being pivoted to the clearance position about the corner.

10. The poke-in electrical connector of claim 1, wherein the arm includes a brace proximate to the base, the brace engaging the housing, the brace defining a pivot point for the arm.

11. The poke-in electrical connector of claim 1, wherein the arm engages the housing to isolate stress in the arm from the base as the arm moves to the clearance position.

12. A poke-in electrical connector comprising:

a housing having a cavity and a poke-in wire channel open to the cavity, the wire channel being configured to receive an electrical wire during a poke-in termination, the housing having a release channel open to the cavity configured to receive a release tool, the housing having a bottom with an opening; and a poke-in electrical contact received in the cavity and held by the housing, the poke-in electrical contact comprising a base and an arm extending from the base, the base extending through the opening at the bottom for surface mounting to a circuit board, the base having a generally planar solder pad exposed at the bottom for soldering to the circuit board, the arm having a poke-in beam configured to engage the electrical wire when poked-in to the corresponding wire channel, the arm having a release tab exposed to the release channel to interact with the release tool, the arm being movable to a clearance position by the release tool interacting with the release tab to release the poke-in beam from the electrical wire to allow the electrical wire to be removed from the wire channel.

13. The poke-in electrical connector of claim 12, wherein the solder pad extends generally parallel to the bottom for surface mounting to the circuit board.

14. The poke-in electrical connector of claim 12, wherein the housing includes a front, a rear, and opposite first and second sides between the front and the rear, the solder pad extending a majority of the depth from the front to the rear and a majority of the width from the first side to the second side.

15. The poke-in electrical connector of claim 12, wherein the poke in electrical contact further comprises a second arm extending from the base, the second arm having a wire interface configured to electrically engage the electrical wire when received in the poke in wire channel.

16. The poke-in electrical connector of claim 12, wherein the solder pad comprises an opening having a plurality of edges, the opening configured to receive solder paste at the edges.

17. A poke-in electrical connector comprising:

a housing having a cavity and a poke-in wire channel open to the cavity, the wire channel being configured to receive an electrical wire during a poke-in termination, the housing having a bottom with an opening; and a poke-in electrical contact received in the cavity and held by the housing, the poke-in electrical contact comprising a base, a first arm extending from a first end of the base and a second arm extending from a second end of the base, the base extending through the opening at the bottom for surface mounting to a circuit board, the base having a generally planar solder pad exposed at the bottom for soldering to the circuit board, the first arm having a poke-in beam configured to engage the electrical wire when poked-in to the corresponding wire channel, the first arm being movable to a clearance position to release the poke-in beam from the electrical wire to allow the electrical wire to be removed from the wire channel, the second arm having a retention barb engaging the housing to secure the poke-in electrical contact to the housing, the second arm having a wire interface configured to electrically engage the electrical wire when received in the poke-in wire channel.

18. The poke-in electrical connector of claim 12, wherein the solder pad extends generally parallel to the bottom for surface mounting to the circuit board.

19. The poke-in electrical connector of claim 12, wherein the housing includes a front, a rear, and opposite first and second sides between the front and the rear, the solder pad extending a majority of the depth from the front to the rear and a majority of the width from the first side to the second side.

20. The poke-in electrical connector of claim 12, wherein the solder pad comprises an opening having a plurality of edges, the opening configured to receive solder paste at the edges.

* * * * *